US011318336B2

(12) United States Patent
Lovas et al.

(10) Patent No.: US 11,318,336 B2
(45) Date of Patent: May 3, 2022

(54) INSTALLED FIRE EXTINGUISHING APPARATUS, ESPECIALLY FOR THE FIRE PROTECTION OF USE LOCATIONS COMPRISING ENDANGERED STRUCTURES SEPARATED FROM EACH OTHER BY SPACES

(71) Applicant: SWISS FIRE PROTECTION RESEARCH & DEVELOPMENT AG, Samen (CH)

(72) Inventors: Laszlo Lovas, God (HU); Andras Tibor Peller, Amwaj Islands (BH)

(73) Assignee: SWISS FIRE PROTECTION RESEARCH & DEVELOPMENT AG

( * ) Notice: Subject to any disclaimer, the term of this patent is extended or adjusted under 35 U.S.C. 154(b) by 0 days.

(21) Appl. No.: 16/768,946

(22) PCT Filed: Dec. 4, 2017

(86) PCT No.: PCT/IB2017/057612
§ 371 (c)(1),
(2) Date: Jun. 2, 2020

(87) PCT Pub. No.: WO2019/111032
PCT Pub. Date: Jun. 13, 2019

(65) Prior Publication Data
US 2021/0220681 A1 Jul. 22, 2021

(51) Int. Cl.
*A62C 35/02* (2006.01)
*A62C 3/06* (2006.01)

(52) U.S. Cl.
CPC ..... *A62C 35/023* (2013.01); *A62C 3/065* (2013.01)

(58) Field of Classification Search
CPC ..... A62C 35/023; A62C 3/065
(Continued)

(56) References Cited

U.S. PATENT DOCUMENTS 5,163,517 A * 11/1992 Kozai ..... A62C 3/06 169/46
5,573,068 A * 11/1996 Sharma ..... A62C 3/06 169/68

(Continued)

FOREIGN PATENT DOCUMENTS

HU 1400270 A2 2/2018
WO 2015/181575 A1 12/2015
WO 2015181617 A1 12/2015

*Primary Examiner* — Chee-Chong Lee
(74) *Attorney, Agent, or Firm* — Olson & Cepuritis, Ltd.

(57) ABSTRACT

The invention relates to an installed fire extinguishing apparatus, which has a pressure-resistant storage body (10) with an internal space (11) for accommodating the fire extinguishing material composition (1) transportable in a pipeline, at least one dispersion device (3), and at least one transport pipeline (20) which is suitable for transporting the fire extinguishing material composition (1) from the internal space (11) of the storage body (10) to the dispersion device (3) arranged at the use location (2), where the storage body (10) is formed by a long pipeline (C) or a pipeline (C) that returns on itself that has a straight line main axis (T) or a main axis (T) of another shape, a trigger part-unit (4) is installed in the transport pipeline (20), and the storage body (10) is connected to a filling fitting (6) serving for filling the fire extinguishing material composition (1) or the components of the fire extinguishing material composition (1) into the internal space (11) of the storage body (10), the storage body (10) is coupled with at least one gas vessel (30), the internal space (31) of the gas vessel (30) is connected to the internal space (11) of the storage body (10) with a connection line (32) that permits the flow of medium, the gas vessel (30) and/or the storage body (10) and/or the connection line (32) has a valve (33) that influences the flow of medium between the gas vessel (30) and the storage body (10). The characteristic feature of the invention is that when the fire (Continued)

Figure 1:
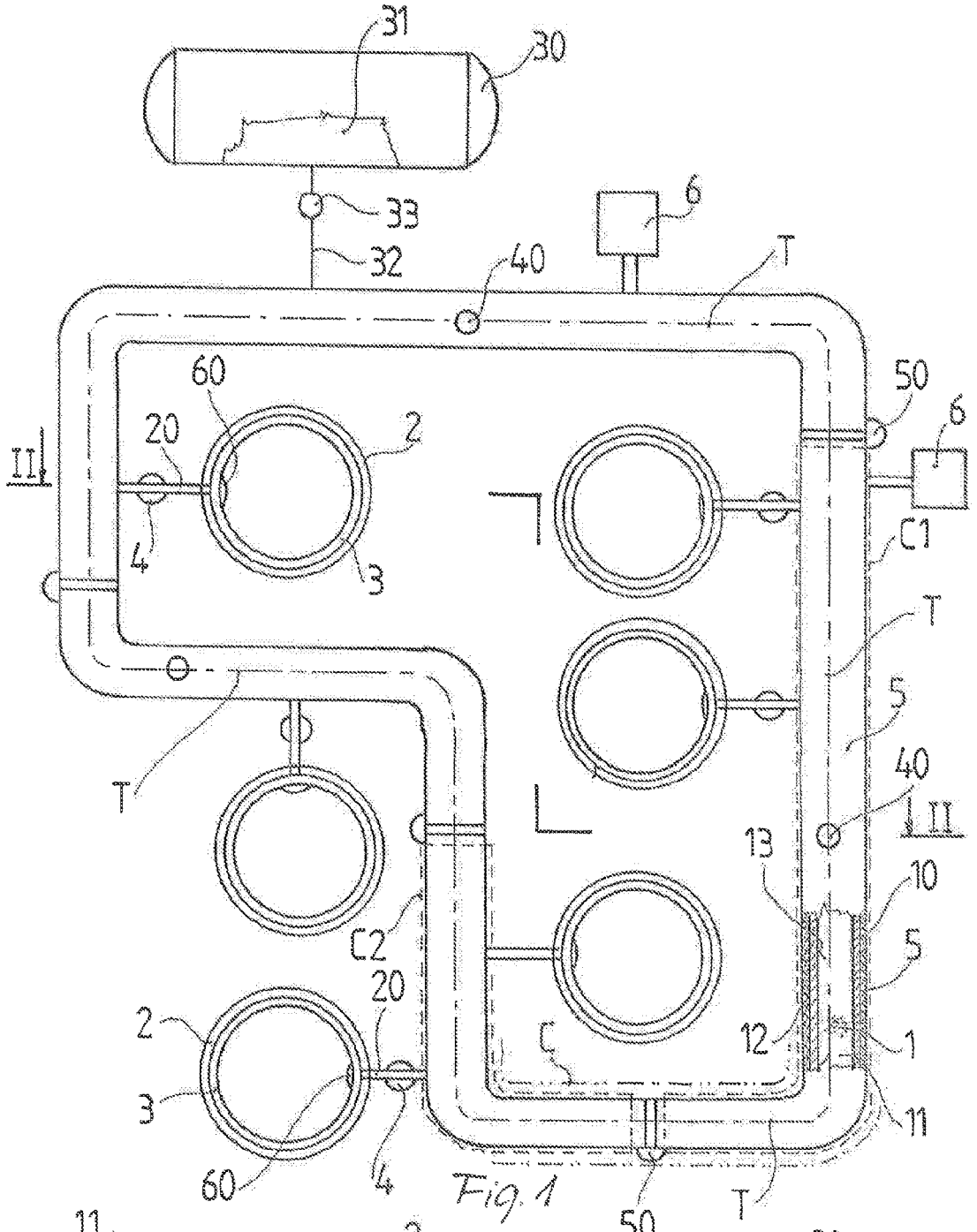

extinguishing apparatus is in a condition ready for use, more than 94% of the internal space (11) of the storage body (10) is filled with fire extinguishing material composition (1), where the composition (1) has a liquid and a gaseous component, and at least a part of the external surface (12) of the storage body (10) is surrounded by a material that reduces temperature fluctuations (5).

10 Claims, 1 Drawing Sheet

(58) Field of Classification Search
USPC ..... 169/46
See application file for complete search history.

(56) References Cited

U.S. PATENT DOCUMENTS

| | | | | |
|---|---|---|---|---|
| 6,186,241 | B1 * | 2/2001 | Murr | A62C 3/06 169/60 |
| 6,237,694 | B1 * | 5/2001 | Chan | A62C 3/06 169/43 |
| 2012/0080203 | A1 | 4/2012 | AlSaffar | |

* cited by examiner

INSTALLED FIRE EXTINGUISHING APPARATUS, ESPECIALLY FOR THE FIRE PROTECTION OF USE LOCATIONS COMPRISING ENDANGERED STRUCTURES SEPARATED FROM EACH OTHER BY SPACES

CROSS-REFERENCE TO RELATED APPLICATIONS

This application is a U.S. National Stage of PCT/IB2017/057612, filed 12 Dec. 2017, which is incorporated herein by reference.

The object of the invention relates to an installed fire extinguishing apparatus, especially for the fire protection of use locations comprising endangered structures separated from each other by spaces, which has a pressure-resistant storage body with an internal space for accommodating the fire extinguishing material composition transportable in a pipeline, at least one dispersion device for applying the fire extinguishing material composition, and at least one transport pipeline connected to the internal space of the storage body and suitable for transporting the fire extinguishing material composition from the internal space of the storage body to the dispersion device arranged at the use location, where the storage body is formed by a long pipeline or a pipeline that returns on itself that has a straight line main axis or a main axis of another shape, a trigger part-unit is installed in the transport pipeline, and the storage body is connected to a filling fitting serving for filling the fire extinguishing material composition or the components of the fire extinguishing composition into the internal space of the storage body, the storage body is coupled with at least one gas vessel, the internal space of the gas vessel is connected to the internal space of the storage body with a connection line that permits the flow of medium, the gas vessel and/or the storage body and/or the connection line has a valve that influences the flow of medium between the gas vessel and the storage body.

Numerous solutions for protecting various locations that pose a fire risk using various materials and operating on the basis of various principles have been created to date. One group includes devices that use a foaming medium for extinguishing. Such a solution is disclosed by, among other documents, patent specification number HU 14 00270, which relates to a foam extinguishing group of devices especially for storing hydrocarbon derivatives, such as oil, the storage body of which is a large-diameter pipeline, which pipeline contains a multi-component fire extinguishing foam charge in a closed space under pressure. This solution may be effectively used for protecting a small number of endangered storage tanks installed separately from each other.

Its disadvantage, however, is that in the case of large, extended sites, e.g. the tank facilities of chemical plants or refineries, the appropriate installation of foam storage tanks established from a pipeline is difficult from the point of view of operation, and in a given case cannot even be realised. The problem is caused by the portion of the gas absorbed into the stored extinguishing foam composition, where the gas phase ensuring the pressure for ejecting the foam accumulates in the upper part of the pipeline. If the pipeline is not horizontal, then this gas phase is concentrated in the uppermost section of the pipeline. When extinguishing a fire occurring at a given tank this may result in this gas amount being ejected from the pipeline before the foam solution, and so the pressure required for the effective ejection of the extinguishing foam remaining in the pipeline drops. And due to this pressure drop, the extinguishing may be unsuccessful as a result of insufficient extinguishing foam intensity.

Publication document number WO 2015/181617 made an attempt to overcome the problem, which prescribes the existence of at least a 6% gas space in the pipeline serving to store the extinguishing material composition in the interest of being able to ensure the appropriate gas pressure. The disadvantage of this solution, however, is that due to providing a large gas space aimed at more reliable operation, the cost of production of the extinguishing system increases due to the extra materials requirement, also the increased requirement for space also increases the installation labour costs, the time required for installation and the investment costs.

A further disadvantage is that this increase of volume does not overcome the requirement for horizontal installation, as this solution does not solve the problem deriving from the accumulation of the propellant gas in the upper section of the pipeline either.

This problem is made worse by the circumstance that due to the unevenness or sloping of the terrain at the use locations to be protected, the long pipeline forming the storage body cannot be positioned horizontally throughout its entire length. Therefore, the uniform fire protection of a more extensive use location cannot be realised with a single system, only with several devices separated from each other that can be installed horizontally. Also, the installation, maintenance and operation costs of such a system are high.

A further disadvantage deriving from smaller apparatus arranged locally is that at a given extinguishing location only a smaller amount of extinguishing material is available, only that is provided by the given apparatus, which in a given case may endanger the effectiveness or even the success of extinguishing. In order to avoid this, apparatuses have to be used with an over-dimensioned storage capacity, which also increases costs.

The objective with the arrangement according to the invention was to overcome the deficiencies of the known installed foam extinguishing apparatuses and to create a version that makes it possible to install the pipeline vessel more simply, and with a smaller gas volume being provided to ensure extinguishing material flow of the appropriate intensity throughout the entire duration of the extinguishing process, and in this way the probability of successful extinguishing increases.

The objective was also for the solution according to the invention to be suitable for realising protection with a uniform, contiguous extinguishing system even in the case of plants extending over a larger area.

The recognition that led to the arrangement according to the invention was that if the pipeline serving for storing the extinguishing material is connected to a gas vessel with appropriate pressure, and if the storage pipeline is suitably insulated, then the maintenance of a minimal gas space in the pipeline accommodating the extinguishing material composition is sufficient, which even in the case of a pipeline storage body installed not horizontally is unable to "accumulate" so much propellant gas at the highest point of the pipeline as to cause extinguishing effectiveness problems, and so the task may be solved.

The idea behind the invention also includes that if the storage body established as a pipeline serving to accommodate the extinguishing material is intentionally laid over a route that is not horizontal, and novel purge fittings for gas discharging are positioned at the high points, and certain connections are established at the low points, then extinguishing reliability can be further increased.

In accordance with the set objective the installed fire extinguishing apparatus according to the invention, especially for the fire protection of use locations comprising endangered structures separated from each other by spaces,—which has a pressure-resistant storage body with an internal space for accommodating the fire extinguishing material composition transportable in a pipeline, at least one dispersion device for applying the fire extinguishing material composition, and at least one transport pipeline connected to the internal space of the storage body and suitable for transporting the fire extinguishing material composition from the internal space of the storage body to the dispersion device arranged at the use location, where the storage body is formed by a long pipeline or a pipeline that returns on itself that has a straight line main axis or a main axis of another shape, a trigger part-unit is installed in the transport pipeline, and the storage body is connected to a filling fitting serving for filling the fire extinguishing material composition or the components of the fire extinguishing composition into the internal space of the storage body, the storage body is coupled with at least one gas vessel, the internal space of the gas vessel is connected to the internal space of the storage body with a connection line that permits the flow of medium, the gas vessel and/or the storage body and/or the connection line has a valve that influences the flow of medium between the gas vessel and the storage body,—is set up in such a way that when the fire extinguishing apparatus is in a condition ready for use, more than 94% of the internal space of the storage body is filled with fire extinguishing material composition, where the composition has a liquid and a gaseous component, and at least a part of the external surface of the storage body is surrounded by a material that reduces temperature fluctuations.

A further feature of the installed fire extinguishing apparatus according to the invention may be that at least one lower point of the lower delimiting line of the internal surface delimiting the internal space of the storage body is located under the other points forming the section surrounding the lower delimiting line as compared to the horizontal, and at least one upper point of the upper delimiting line of the internal surface delimiting the internal space of the storage body is located above the other points forming the section surrounding the upper delimiting line.

In the case of another version of the installed fire extinguishing apparatus, the connection line of the gas vessel is connected to the internal space of the storage body at at least one position of the storage body established as a pipeline. Optionally a purge fitting is connected to the internal space of the storage body at at least one upper point of the storage body established as a pipeline or in its environment.

In the case of yet another different embodiment of the invention, the storage body established as a pipeline is divided into at least two pipeline sections, and sectioning valves influencing the flow of medium between the pipeline sections are installed between two neighbouring pipeline sections.

In the case of yet another different embodiment of the installed fire extinguishing apparatus, the storage body is set up as a vessel.

In the case of another embodiment of the invention, the storage body is entirely recessed under the ground surface, and so the material layer that reduces temperature fluctuations surrounding the external surface of the storage body is the accommodating earth itself.

In the case of another different version of the installed fire extinguishing apparatus on at least a part of the storage body the material layer that reduces temperature fluctuations is heat insulation or shield, or optionally on at least a part of the storage body the material layer that reduces temperature fluctuations is a layer of paint at least partially reflecting solar radiation.

From the point of view of the installed fire extinguishing apparatus it may be preferable if the gas vessel is established as a high-pressure bottle.

In the case of another version of the invention the transport pipeline is connected to the lower side of the storage body. It is preferable if the transport pipeline is connected to the internal space of the storage body in the lower delimiting line of the internal surface delimiting the internal space of the storage body or in the vicinity of the lower delimiting line.

In the case of still another different embodiment of the installed fire extinguishing apparatus, at least one abnormality-detecting body is located at the use location. The abnormality-detecting body has a fire detector.

In the case of another embodiment of the invention, the use location is a structure at least periodically accommodating combustible material.

The installed fire extinguishing apparatus according to the invention has numerous preferable features. The most important of these is that as a result of the novel arrangement it becomes possible to use a pipeline-type extinguishing material storage body with a smaller diameter in such a way that not only does the manufacture and installation of the storage body become simpler and more economical, but the continuous emission of the extinguishing material at the appropriate flow rate can also be realised, and therefore extinguishing efficiency and extinguishing reliability may also become greatly improved.

The advantages also include that the uncertain extinguishing systems of large tank depots and plants may be modernised, and their extinguishing performance increased for a small investment.

Another feature that must be viewed as an advantage is that as a result of the novel solution local propellant gas pockets of a significant size are unable to develop in the essentially completely filled storage space of the pipeline, that could quickly escape from the system when extinguishing is launched through any transport pipeline. In this way the extinguishing can be performed more smoothly, and the propellant gas leaves the storage body at the end of the extinguishing process.

A feature that can be viewed as an economic advantage is that a smaller amount of extinguishing material needs to be stored for the operation of the newly installed fire extinguishing apparatus according to the invention, because the extinguishing material emitted from the pipeline at a greater pressure and at a continuous rate even towards the end of the extinguishing process, results in more effective fire extinguishing. As a consequence of this, the extinguishing process can be completed in a shorter time, which has a beneficial effect on specific extinguishing costs.

Further details of the installed fire extinguishing apparatus according to the invention will be explained by way of embodiments with reference to figures. Wherein FIG. 1 depicts a top view of a schematic image of a version of the apparatus according to the invention, FIG. 2 depicts a stepped cross-section of the apparatus according to FIG. 1, taken by the line II-II.

Figure 2:
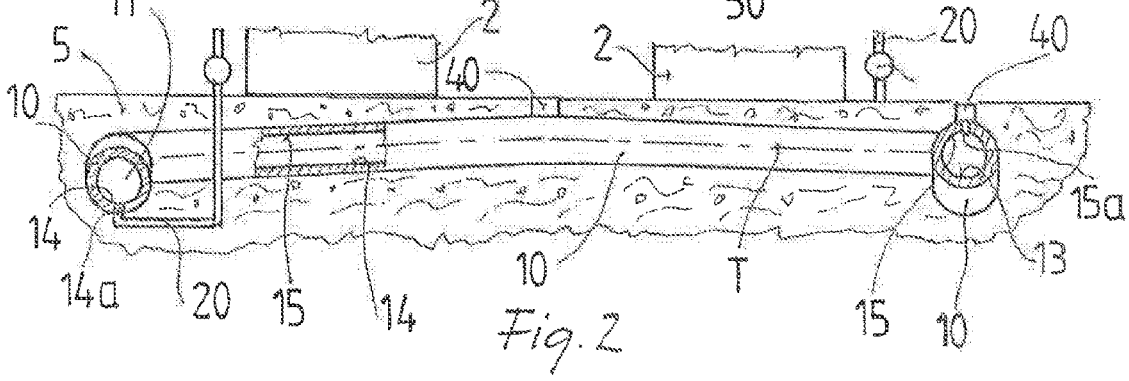

A version of the installed fire extinguishing apparatus according to the invention can be seen in FIG. 1 that can be used to good effect in the case of tank depots storing combustible, flammable and explosive materials, such as crude oil refineries, pharmaceutical plants and chemical industry facilities.

It may be observed that the pipeline "C" running between the individual use locations 2 forms the storage body 10 suitable for accommodating the fire extinguishing material composition 1. In the case of the present version the pipeline "C" forming the storage body 10 is established as a ring returning onto itself. Here the pipeline "C" forming the storage body 10 itself is divided into a pipeline section "C1" and a pipeline section "C2" with the help of the sectioning valves 50. Depending on the status of the sectioning valves 50 the pipeline section "C1" and the pipeline section "C2" can be connected to each other or isolated from each other.

The other great advantage of the positioning of the sectioning valves 50 is that in the case of physical damage to a given pipeline section "C1", "C2", the operation of the undamaged pipe sections can be continued by closing the sectioning valves 50, and in the case of a pipeline "C" arrangement where it returns onto itself, the entire remaining volume may be used.

The storage body 10 has at least one filling fitting 6 the task of which is to fill the internal space 11 of the storage body 10 delimited by its internal surface 13 with fire extinguishing material composition 1, and optionally the circulation of the fire extinguishing material composition 1 already filled into the internal space 11 of other pipeline sections by making it flow between the filling fittings 6.

The internal space 11 of the storage body 10 is connected to transport pipelines 20 leading to the use locations 2. Here trigger part-units 4 are installed in the transport pipelines 20, the task of which is in the case of any abnormality, e.g. in the case of a fire occurring at a use location 2, to make it possible for the fire extinguishing material composition 1 to pass from the internal space 11 of the storage body 10 via the transport pipeline 20 to the use location 2. In the interest of this the dispersion device 3 is connected to the end of the transport pipeline 20 at the use location 2, which dispersion device 3 disperses the fire extinguishing material composition 1 arriving on the transport pipeline 20 at the use location 2 so that the fire occurring there can be extinguished.

Also, in the interest of the monitoring personnel or the control centre of the fire extinguishing apparatus being informed of an emergency, e.g. fire, occurring at the use location 2, optionally even from a larger distance, the use location 2 has an abnormality detecting body 60. The abnormality detecting body 60 may be a fire detector, smoke detector or any device that is capable of detecting a significant physical and/or chemical change at the given use location 2, and sending a signal about this change to the location where a decision is made about the intervention.

FIG. 1 also well illustrates that the pipeline "C" of the storage body 10 is connected to the gas vessel 30 via the connection line 32 that permits the flow of medium. Cost-effectively the gas vessel 30 may be constructed from, for example, a group of standard industrial gas cylinders, or as a pipe section manufactured from the same material as the pipeline "C". As high-pressure gas is stored in the internal space 31 of the gas vessel 30, which is also absorbed into the fire extinguishing material composition 1 located in the internal space 11 of the storage body 10 as its gas phase. In the case of intervention required at a use location 2 this gas is suitable for pushing the fire extinguishing material composition 1 in the internal space 11 of the storage body 10 through the given transport pipeline 20 into the dispersion device 3 at any endangered use location 2. In the case of the given embodiment a valve 33 is installed in the connection line 32 that regulates the flow of the gas in the internal space 31 of the gas vessel 30 into the internal space 11 of the storage body 10. Naturally, the valve 33 may also be located on the gas vessel 30 and on the storage body 10 as well.

Naturally, in the case of a system that extends over a significantly larger area it may become necessary to install several gas vessels 30, the reason for which is that there be a sufficient amount of propellant gas connected to a remote section of the pipeline "C" in the case of extinguishing being started towards any use location 2, which ensures the transporting of the fire extinguishing material 1 located more remotely. In addition, the remotely located gas vessels 30 make it possible to transport the fire extinguishing material 1 even in the case of height differences.

It may also be seen in FIG. 1 that the pipeline "C" forming the storage body 10 is coated with a material layer that reduces temperature fluctuations 5, at least on a part of the external surface 12 of the storage body 10, preferably on the larger part of it. The task of the material layer that reduces temperature fluctuations 5 is to protect the internal space 11 of the storage body 10 from greater temperature changes occurring in the external environment and from solar radiation, and also from excessive cooling and to ensure a nearly constant temperature within given limits in the internal space 11 of the storage body 10. This is important because under a substantially constant temperature the heat expansion of the fire extinguishing material composition 1 located in the internal space 11 of the storage body 10, changes in the proportion of the dissolved propellant gas, and therefore pressure fluctuations are minimal. This is needed, on the one hand, so that the internal space 11 of the storage body 10 can be filled with fire extinguishing material composition 1 to at least 94%. The smaller the amount of free gas phase in the internal space 11 of the storage body 10, the more certain it is that the amount of free gas phase accumulating at one place due to the deviation of the main axis "T" of the storage body 10 from the horizontal in the course of the installation of storage body 10 is able to disadvantageously influence the efficiency of extinguishing. On the other hand, the excessive and repeated heating and cooling of the fire extinguishing material composition 1 stored in the pipeline "C" (for example in pipeline sections exposed to solar radiation) would accelerate the ageing and deterioration of the foaming material, therefore by reducing heat fluctuation the lifetime of the fire extinguishing material 1 may be significantly extended.

It must be mentioned here that if the pipeline "C" of the storage body 10 is recessed under the soil, then the soil covering the external surface 12 of the storage body 10 itself may also serve as the material layer that reduces temperature fluctuations 5. Naturally in this case, the depth of installation of the pipeline "C" of the storage body 10 and the thickness and composition of the covering soil layer must comply with certain conditions.

If the pipeline "C" of the storage body 10 may not be located under the ground for its entire length, then it is possible to establish the material layer that reduces temperature fluctuations 5 as a heat-insulation covering fitted to the pipeline, as a shade or shield against solar radiation, or as reflective (light coloured) paint significantly reducing the absorption of solar radiation. In the latter two cases if protection against cooling is not realised, and the climate conditions make it justified, the fire extinguishing material composition 1 must be mixed with an antifreeze additive.

It is apparent from FIG. 1 that the main axis "T" of the pipeline "C" forming the storage body 10 is not a straight line, instead it complies with the positions of the use locations 2 and runs along a path that is not straight.

Moving over now to FIG. 1, it can be seen in it that the main axis "T" of the pipeline "C" of the storage body 10 is intentionally positioned in a manner that is not horizontal so that there is at least one point, but preferably a small section, in individual sections of the lower delimiting line 14 of the internal surface 13 delimiting the internal space 11 of the storage body 10 the lower point 14*a* of which is lower than the other parts of the lower delimiting line 14 of the internal surface 13 in the vicinity of the lower point 14*a*. Furthermore, there should be at least one point, but preferably a small section in individual sections of the upper delimiting line 15 of the internal surface 13 delimiting the internal space 11 of the storage body 10 the upper point 15*a* of which is higher than the other parts of the upper delimiting line 15 of the internal surface 13 in the vicinity of the upper point 15*a*.

The conscious laying of the pipeline "C" in this way ensures that the liquid phase of the fire extinguishing material composition 1 is located in the vicinity of the lower points 14*a* and that the gas phase that has left the fire extinguishing material composition 1 is located in the vicinity of the upper points 15*a*. If the path of the main axis "T" of the pipeline "C" is suitable, then the smaller gas pockets developing in the individual upper points 15*a* may be separated from the liquid phase accumulating in the lower points 14*a*, and therefore the size of the gas pockets will be so small that they are unable to influence the extinguishing efficiency during the extinguishing process in any way whatsoever.

In addition to this, purge fittings 40 may be located near to the upper points 15*a* with which, if necessary, the precipitated gas phase in the internal space 11 of the storage body 10 may be removed from the internal space 11 of the storage body 10, and optionally it may be forwarded to the gas vessel 30 with the help of an appropriate device, such as a compressor. What is more, the lower points 14*a* may be established along the path of the main axis "T" of the pipeline "C" so that the connections of the transport pipelines 20 are located in the vicinity of these lower points 14*a*. In this way it is completely impossible that in the case of a fire occurring at a given use location 2 a larger amount of propellant gas gets into the given transport pipeline 20 when extinguishing is started and this leading to accidental venting in the given pipeline section "C1". With this it is even more certain that the efficiency of extinguishing can be increased.

It must be noted here that the storage body 10 and the gas vessel 30 of the fire extinguishing apparatus may be fitted with measuring and intervention elements the measure and indicate given characteristics of the internal space 11 of the storage body 10 and of the internal space 31 of the gas vessel 30, and make possible any necessary interventions. However, these structural units and known of in themselves, and have no uniqueness at all from the point of view of the present invention. Therefore, due to their known nature no description will be made of them.

During the use of the fire extinguishing apparatus according to the invention first of all the path of the pipeline "C" of the storage body 10 must be created. However, during this the earth excavators do not have to form a trench with a highly precise horizontal base, instead with consideration to the use locations 2 the main axis "T" of the storage body 10 can be determined so that at certain sections of the pipeline "C" the lower points 14*a* are on the lower delimiting line 14 of the internal surface 13 encompassing the internal space 11 of the storage body 10 and so that the upper points 15*a* are on the upper delimiting line 15. After positioning the storage body 10 the transport pipelines 20 can be connected to the lower points 14*a*, while purge fittings 40 may be fitted at the upper points 15*a*.

Following this, in a known way and therefore not detailed, the dispersion devices 3 and the abnormality-detecting bodies 60 linked to the transport pipelines 20 can be installed. Then the storage body 10 may be connected to the gas vessel 30 via the connection line 32, and then a filling fitting 6 and, if required, sectioning valves 50 may be fitted to the storage body.

After this the storage body 10 can be buried and in this way covering the external surface 12 of the storage body 10 with the material layer that reduces temperature fluctuations 5 is also realised.

Following the installation of the fire extinguishing apparatus the internal space 11 of the storage body 10 can be filled with the desired fire extinguishing material composition 1 via the filling fitting 6. In the case of several separate pipeline sections C1, C2 it is possible to install separate filling fittings 6 and by creating circulation between them the fire extinguishing material composition 1 in each of the pipeline sections C1, C2 can be homogenised. After filling has been completed, the high pressure gas phase can be filled into the internal space 31 of the gas vessel 30, then by opening or closing the valve 33 the high pressure gas phase can be filled into the internal space 11 of the storage body 10 via the connection line 32.

After filling the internal space 11 of the storage body 10 the purge fittings 40 of the storage body 10 may be opened and the gas pockets accumulated in the vicinity of the upper points 15*a* or a part of them can be released. In this way it can be ensured that when the fire extinguishing apparatus is in a condition ready for use the volume taken up by the fire extinguishing material composition 1 in the internal space 11 of the storage body is greater than 94% and the total volume of the gas pockets is smaller than 6%. From the point of view of the operation, the most preferable state of the gas pockets is when the technically achievable smallest amount of gas remains in the pipeline "C", and when the amount of gas required for ensuring a constant extinguishing performance is stored in the gas vessel 30.

In the case of an emergency, e.g. fire, occurring at a use location 2 the ready-for-use fire extinguishing apparatus operates similarly to what is usual. The abnormality-detecting body 60 detects the occurrence of a fire and sends a signal to the central unit. Then by opening the trigger part-unit 4 belonging to the given use location 2 the central unit makes it possible for the fire extinguishing material composition 1 in the internal space 11 of the storage body 10 to pass into the transport pipeline 20 and from there to the dispersion device 3.

It is noted here that a solution may also be conceived in which the abnormality-detecting body 60 directly influences the operation of the trigger part-unit 4, and the trigger part-unit 4 launches the extinguishing process without intervention from the central unit.

The amount of foaming fire extinguishing material composition 1 flowing into the dispersion device 3 through the transport pipeline 20 reduces the amount of fire extinguishing material composition 1 remaining in the internal space 11 of the storage body 10, and so after a time its pressure would drop. At this time the valve 33 opens and the high-pressure gas phase forming a component of the fire extinguishing material composition 1 in the internal space 31 of the gas vessel 30 flows through the connection line 32 into the internal space 11 of the storage body 10, so restoring the pressure required for effective extinguishing, and the foaming ability of the fire extinguishing material composition 1.

After the extinguishing process has been completed the internal space 11 of the storage body 10 may be again filled with the required amount and composition of the fire extinguishing material composition 1 via the filling fitting 6.

It must be noted here that the costs of extinguishing may also be reduced if after completing the extinguishing at a given use location 2 the trigger part-unit 4 closes or the sectioning valves 50 are closed in the pipeline section "C1" and pipeline section "C2" of the pipeline "C" of the storage body 10 not involved in extinguishing. Naturally, this solution may be used if each pipeline section "C1" and pipeline section "C2" delimited by the sectioning valves 50 has a connection line 32 connection that makes it possible to directly take the high-pressure gas phase in the internal space 31 of the gas vessel 30 to the given pipeline section "C1" or pipeline section "C2".

It is also important to note that the purge fittings 40 are not only suitable for regulating the size of the gas pockets developed in the vicinity of the upper points 15*a*. They also make it possible to regulate the composition of the fire extinguishing material composition 1 in the internal space 11 of the storage body 10, e.g. by removing the precipitated gas phase, and replacing it while mixing via the filling fitting 6.

The installed fire extinguishing apparatus according to the invention may be used to good effect in all cases when foam extinguishing needs to be performed with greater than usual effectiveness and economy with greater reliability, especially in the case of facilities located over a large area in the case of which the task could only be solved with several separate extinguishing systems.

LIST OF REFERENCES

| | |
|---|---|
| 1 fire extinguishing material composition | |
| 2 use location | |
| 3 dispersion device | |
| 4 trigger part-unit | |
| 5 material layer that reduces temperature fluctuations | |
| 6 filling fitting | |
| 10 storage body | 11 internal space |
| | 12 external surface |
| | 13 internal surface |
| | 14 lower delimiting line |
| | 14a lower point |
| | 15 upper delimiting line |
| | 15a upper point |
| 20 transport pipeline | |
| 30 gas vessel | 31 internal space |
| | 32 connection line |
| | 33 valve |
| 40 purge fitting | |
| 50 sectioning valve | |
| 60 abnormality-detecting body | |
| "C" pipeline | "C1" pipeline section |
| | "C2" pipeline section |
| "T" main axis | |

The invention claimed is:

1. Installed fire extinguishing apparatus for fire protection of structures separated from each other by spaces, the installed fire extinguishing apparatus comprising a pressure-resistant storage body (10) in the form of pipeline (C) having a main axis (T), an external surface (12) at least in part surrounded by a material (5) that reduces temperature fluctuations, an internal surface (13) having a lower delimiting line (14) and an upper delimiting line (15) and defining an internal space (11) for accommodating a fire extinguishing material composition (1) having a liquid component and a gaseous component transportable in a pipeline, at least one dispersion device (3) connected to the storage body (10), a use location (2) for applying the fire extinguishing material composition (1), and at least one transport pipeline (20) connected between the internal space (11) and the dispersion device (3) and suitable for transporting the fire extinguishing material composition (1) from the internal space (11) to the dispersion device (3), a trigger part-unit (4) in the transport pipeline (20), and a filling fitting (6) on the storage body (10) for filling the fire extinguishing material composition (1) into the internal space (11), the storage body (10) further being in communication with at least one gas vessel (30), defining an internal space (31) connected to the internal space (11) with a connection line (32) provided with a valve (33) that permits flow of the fire extinguishing material composition (1) between the gas vessel (30) and the storage body (10) when the fire extinguishing apparatus is in a condition ready for use, and more than 94% of the internal space (11) of the storage body (10) is filled with fire extinguishing material composition (1), wherein the pipeline (C) has at least one lower point (14*a*) of the lower delimiting line (14) of the internal surface (13), under at least one transport pipeline (20) connected to the internal space (11) of the storage body (10) at said at least one lower point (14*a*) of the lower delimiting line (14) of the storage body (10), and at least one upper point (15*a*) of the upper delimiting line (15) of the internal surface (13) located above said at least one lower point (14*a*), and a purge fitting (40) is connected to the internal space (11) of the storage body (10) at said at least one upper point (15*a*) of the upper delimiting line (15) of the storage body (10).

2. The installed fire extinguishing apparatus according to claim 1, characterised by that the connection line (32) of the gas vessel (30) is connected to the internal space (11) of the storage body (10) at at least one position of the storage body (10) established as a pipeline (C).

3. The installed fire extinguishing apparatus according to claim 1, characterised by that the storage body (10) established as a pipeline (C) is divided into at least two pipeline sections (C1, C2), and sectioning valves (50) influencing the flow of medium between the pipeline sections (C1, C2) are installed between two neighbouring pipeline sections (C1, C2).

4. The installed fire extinguishing apparatus according to claim 1, characterised by that the storage body (10) is entirely recessed underground.

5. The installed fire extinguishing apparatus according to claim 1, characterised by that on at least a part of the storage body (10) the material layer reducing temperature fluctuations (5) is heat insulation.

6. The installed fire extinguishing apparatus according to claim 1, characterised by that on at least a part of the storage body (10) the material layer that reduces temperature fluctuations (5) is a layer of paint at least partially reflecting solar radiation.

7. The installed fire extinguishing apparatus according to claim 1, characterised by that the gas vessel (30) is a high-pressure bottle.

8. The installed fire extinguishing apparatus according claim 1, characterised by that at least one abnormality-detecting body (60) is located at the use location (2).

9. The installed fire extinguishing apparatus according to claim 8, characterised by that the abnormality-detecting body (60) has a fire detector.

10. The installed fire extinguishing apparatus according to claim 1, characterised by that the use location (2) is a structure at least periodically accommodating combustible material.

* * * * *